United States Patent [19]

Matas et al.

[11] 3,997,372

[45] Dec. 14, 1976

[54] HIGH STRENGTH LOW ALLOY STEEL

[75] Inventors: Stephen J. Matas, Independence; Raymond E. Mintus, Warren; John B. Ballance, Bedford Heights, all of Ohio; George J. Klems, Bethel Park, Pa.

[73] Assignee: Republic Steel Corporation, Cleveland, Ohio

[22] Filed: June 12, 1975

[21] Appl. No.: 586,197

Related U.S. Application Data

[63] Continuation of Ser. No. 475,887, June 3, 1974, abandoned.

[52] U.S. Cl. ..... 148/36; 75/123 E; 75/123 J; 75/124; 148/12 F

[51] Int. Cl.[2] ..... C22C 38/12

[58] Field of Search ..... 148/12 F, 36; 75/123 R, 75/123 E, 123 J, 124

[56] References Cited

UNITED STATES PATENTS

| | | | |
|---|---|---|---|
| 3,661,537 | 5/1972 | Aronson et al. | 75/123 E |
| 3,666,570 | 5/1972 | Korchynsky et al. | 148/36 |
| 3,897,279 | 7/1975 | Shaughnessy et al. | 148/12 F |
| 3,947,293 | 3/1976 | Takechi et al. | 148/12 F |

FOREIGN PATENTS OR APPLICATIONS

| | | | |
|---|---|---|---|
| 1,007,175 | 10/1965 | United Kingdom | 75/123 M |

OTHER PUBLICATIONS

Sekine, et al; "Effect of Nb or/and V Addition and the Amounts of Extracted Carbides on the Strengthening of Hot Rolled Steels," Jour. Iron U.S. Steel Inst. of Japan; 1970, vol. 56 pp. 569–590.

"The Development of Pearlite–Free, Precipitation–-Hardening Structural Steels;" Stahl und Eisen, Bartholot et al., vol. 91(4), 2/18/1971, pp. 204–220.

Journal of the Iron and Steel Institute, 2/67 pp. 161,176,179–182.

*Primary Examiner*—Arthur J. Steiner

*Attorney, Agent, or Firm*—Cooper, Dunham, Clark, Griffin & Moran

[57] ABSTRACT

A low alloy steel having a composition containing columbium, vanadium and silicon, advantageously in specified ranges of content, has demonstrated superior mechanical properties, comprising yield strength above 80 ksi, excellent toughness including good impact strength at low temperatures, and good formability evidenced by a suitably high percent elongation. The steel in its preferred embodiments includes a significant amount of manganese, and is economically producible in as-hot-rolled state to achieve the stated properties, subject to attainment of even higher strength by an aging treatment.

11 Claims, No Drawings

HIGH STRENGTH LOW ALLOY STEEL

This is a continuation of application Ser. No. 475,887, filed June 3, 1974, now abandoned.

BACKGROUND OF THE INVENTION

This invention relates to high strength, low alloy steels, particularly of low carbon category, having yield strength of at least about 80 ksi (80 thousand pounds per square inch), and very preferably superior toughness, especially at low temperatures. More particularly, the invention is concerned with steel products achieved by hot deformation, e.g. by hot rolling to desired thicknesses and shapes, including sheet, strip or the like, wherein the desired properties of yield strength, toughness and also advantageously ductility, fatigue resistance and weldability are attained with an economy of alloying ingredients.

Considerable demand exists for hot rolled steel products of the sort described above, which can be formed readily in a variety of fabricating operations such as in the automotive and other industries. Steels designed to serve these purposes, and having yield strength of the value noted above, have been proposed or made available, but to the extent that they have avoided an expensive content of alloying elements and have not required heat treatments that add to the cost or complexity of processing, such 80 ksi or like steels appear to have been somewhat deficient in respect to properties such as toughness and ductility.

Accordingly, an important aim of the present invention is to provide a new steel product which is of low alloy type and which not only has the basic properties of strength described above, but is characterized by improved ductility and greater toughness, notably improved impact strength at temperatures well below 0° F, such improvements being considered in relation to prior steel products which might be considered approximately comparable in some other respects. Very good formability and exceptional toughness at very low temperatures are special objects of the invention, for correspondingly greater utility as to kinds of articles that may be fabricated from the steel, and greater latitude in their circumstances of use.

SUMMARY OF THE INVENTION

To the above and other ends, and especially for economical attainment of high-strength steel products of the character described, an important aspect of the invention embraces the discovery of a special, low-alloy composition, that affords novel results in production and use. A composition which is unusually effective has been found to comprise columbium, vanadium, and silicon, in a manganese-containing steel that has a relatively low carbon content, e.g. not over about 0.1%. With this composition, and very advantageously by the employment of preferred ranges for the stated elements as explained below, steel has been produced with the desired yield strength of 80 ksi or above and with very good toughness as well, particularly including high impact strength at low temperatures, even down to −100° F. Steel products having these characteristics have been made, from ingot-derived slab or the like, by hot rolling and suitable cooling procedure, conveniently without requiring any special heat treatment or the like in order to develop the properties of strength. Unlike some prior steels of this class, moreover, the compositions of the present invention do not appear to be sensitive to minor changes in processing, e.g. as in hot rolling, cooling, and the like, so that there is no special difficulty in production control to achieve the desired properties uniformly through successive heats and rolling operations.

A further advantage of the steels is that they appear to have good ductility, e.g. as measured by conventional determinations of elongation, and also may have suitable weldability. Although for many purposes the products are abundantly useful in the as-hot-rolled condition, for example in affording yield strengths upwards of 80 ksi when converted to desired product form by hot rolling or other hot deformation (e.g. to a thickness reduction of at least about 50%), it is found that these compositions can be age-hardened, in a simple manner, to provide still higher yield strengths, e.g. of the nature 90 ksi and above.

Presently preferred compositions of the invention, now found to achieve very satisfactory realization of all of the objects, include a columbium content somewhat higher than the amount employed in many previous alloys, i.e. a content above 0.05%, and advantageously in the range of 0.06 to 0.15%. A significant amount of vanadium is included, as from 0.04% to 0.1%, it being specifically found that in these compositions of the invention, columbium and vanadium are not to be considered as alternatives, i.e. they are not interchangeable as has sometimes been indicated for prior alloys. A content of silicon has been found important, and indeed requisite, for the special results described above, advantageously a content of 0.4% and above, being greater than might in some circumstances be considered an incidental or ordinary amount; desirably the silicon content is 0.2% or greater, and can usefully be over (and indeed substantially over) 0.3%. A presently preferred range for silicon is 0.4% and above, and indeed quite preferably 0.5 to 0.6%.

The improvement in properties by the described combination of alloying elements appears to be unusual and quite different from the effects that might have been expected by past experience with the individual elements, and in fact different from the results of trials involving addition of certain elements separately. Thus, in one set of tests when vanadium was added to a columbium steel, i.e. a steel relying essentially on columbium for strength properties and having no special content of silicon, there was an increase in yield strength, but there was also a reduction in toughness. It is known, moreover, that the addition of silicon, e.g. in significant amounts, has generally been found to reduce toughness even though it may have effects in improving hardness or some other aspect of strength.

In the complete combination of alloying ingredients, which represents a special feature of the invention, it has now been discovered that the addition of vanadium and silicon together (in steel having the defined content of manganese and columbium) avoids significant reduction of toughness, and that the resulting alloy, instead of showing poor values of toughness or ductility at the desired high levels of yield strength, shows excellent toughness or impact strength as well as good ductility as measured by high total elongation. Indeed, it appears that there is an unexpected synergistic effect among the alloy constituents, presumably involving synergism among vanadium, silicon and columbium, preferably as employed in the manganese-containing composition, for attainment of toughness and ductility.

In consequence, the steel products are not only desirably strong but tough and excellently formable and thus have a wide utility. Indeed, their economic value is especially high, because they are relatively inexpensive to produce and are capable of employment in circumstances where more costly products or heavier gauges of other products might have otherwise been required.

The steels are preferably made with a suitable sulfide shape control agent, being one or more of the additions heretofore known for control of sulfide shape in steels of this general class. That is to say, sulfide inclusions that are unavoidably or even for some purposes desirably present, notably manganese sulfides, usually appear as globular or oval in shape before hot rolling. After hot rolling, the sulfides tend to be abnormally elongated, in the rolling direction. This adversely affects the transverse ductility and toughness properties of the product. By addition, however, of certain shape control agents (which presumably reduce the plasticity of the inclusions), the sulfides can be kept in oval configuration, with corresponding preservation of ductility and toughness properties in transverse as well as longitudinal directions. This shape control agent, conveniently so designated even though it may in fact be plural, can be one or more elements selected from the group consisting of the rare earth metals (e.g. cerium, lanthanum, or others as known), zirconium, and in some cases selenium or tellurium. The function of such agents is well recognized.

As indicated, an important, cooperating element in the compositions is manganese, usefully present in moderate rather than very low amount, e.g. 0.3% and above, and advantageously a range over 0.4%, i.e. 0.8 to 1.65%. It also appears desirable to have a small content of nitrogen, for example up to 0.03%, it being thought that the effect of columbium and vanadium is in part achieved by a kind of precipitation hardening including the deposition of carbonitrides of these elements. As noted, the carbon content is advantageously low and indeed can presumably be very low, but it appears that for satisfactory results, in general, expensive procedure to bring carbon down to extremely small values is unnecessary. For instance, it is understood that a carbon content as low as 0.03% is readily obtainable in good electric furnace practice or the like, and indeed excellent results have been achieved in the present invention with carbon in the range of 0.05 to 0.1%.

DETAILED DESCRIPTION

As indicated above, the steels of this invention, conveniently produced in economical manner without special heat treatment or the like, are characterized by yield strengths upwards of 80 ksi, ultimate tensile strength upwards of 90 ksi, ductility as measured by percent elongation (2 inches) in excess of 20%, and superior low temperature toughness. In particular, as measured by half-size Charpy V-notch specimens, in conventional manner, the steel showed impact strength of at least about 20 foot-pounds in the longitudinal direction and 10 foot-pounds in the transverse direction, at −100° F. The steel is also preferably characterized, in the preferred compositions, by superior transverse and longitudinal formability, good fatigue resistance, and good weldability. All of the foregoing properties are achieved in the as-hot rolled condition, i.e. being the steel as directly resulting from suitable hot rolling and cooling procedures.

The steel is prepared in an essentially conventional way, e.g. for making a relatively low carbon, low alloy steel, following known practices for producing a clean steel, with good control of desired contents of small percentages of alloying elements. Thus the basic melt is achieved in a usual manner, as in a standard electric or basic oxygen furnace, appropriate attention being paid to the desired low carbon content, whether by conventional decarburization if necessary, or otherwise. It is understood that carbon levels as low as 0.03% are effectively obtainable without special treatment of the melt after tapping, and indeed present results have been very good with steels having a carbon range of 0.06 to 0.1%, which pose no special problem in melting practice.

Additions of the several required elements to the basic charge of scrap, iron, and the like are made in the manner appropriate for such materials, the manganese being added in the furnace and/or ladle, e.g. as ferromanganese. Very preferably, the minor, special alloying additions, being columbium and vanadium, are effected by adding appropriate material (for example, as ferroalloys) to the melt in the ladle after tapping. Silicon, unless present in sufficient amount by selection of materials of the original charge, can be added to the furnace and/or ladle to the extent necessary, e.g. as ferrosilicon. A desired nitrogen level above about 0.01% can be achieved by the addition of high nitrogen bearing ferro-alloys, the manner of adjusting the proportion of nitrogen in steel, within the ranges noted elsewhere herein, being well known in practice.

The steel composition of this invention must be fully deoxidized. Deoxidation is very preferably achieved by addition of aluminum, e.g. to the ladle. Although conceivably other deoxidation practice may be followed, it is presently deemed desirable to reduce oxygen to very low values, i.e. less than 0.005%.

Another ladle and/or mold addition may preferably be a sulfide shape control agent which, as explained above, is selected from the elements known for such function. The rare earth elements are presently conventional and effective for this purpose, and are suitable for the compositions of the invention. Thus one or more of the elements such as cerium, lanthanum, or others as well known may be employed. For example, compositions consisting primarily of cerium and lanthanum are commercially available for use as additions to steel melts, and serve effectively. Alternatively, when the level of nitrogen is low, addition of zirconium may be employed, and in some instances addition of substances such as selenium or tellurium.

After pouring the steel of the melt, which has been suitably controlled as to content of the several required elements, the resulting ingots are handled in conventional way, being reduced to slab or the like, for final reduction by appropriate hot deformation. For most purposes, this is effected by hot rolling, for example through the requisite number of passes, to a selected finish temperature, for instance in the range of about 1,500° F to 1,850° F. The desired product, e.g. sheet, strip, or other shape delivered by the hot mill at the desired temperature, is appropriately cooled, for example at rates in the range of about 15° to 135° F per second (with air, or with water spray or jet if needed), down to a selected temperature, as in the range of about 900° to 1,300° F. The strip or sheets or other products are then collected by coiling or piling at the last-mentioned temperature, and thereafter allowed, in usual fashion, to cool very slowly as so collected.

The improved high strength, low alloy steels can be produced, as hot rolled product, in a usefully wide variety of gages, for instance from about 0.05 to 0.5 inch, particularly 0.08 inch and upwards; a thickness range of special utility, economically realizing all of the superior properties of yield strength, toughness, ductility and formability, is from about 0.09 to about 0.35 inch. In all cases, the desired yield strength of 80 ksi or better is readily achieved.

It is found, moreover, that significant increase in such strength to 90 ksi or higher is obtainable (without substantially impairing toughness or other properties), where desired, by a simple aging treatment of the coiled or other finished hot rolled product; such treatment can be of a sort otherwise known for aging, as by heating to a suitable temperature, e.g. 1000° to 1300° F for a required time, such as 5 minutes to three hours. Thus aging for one half hour at 1100° F has been found very effective, i.e. attaining the stated results on tests with steel from hot-rolled coils in the examples below.

One example of a heat made to have the new composition yielded hot rolled product with the following analysis (all figures here and elsewhere being in weight percent, and in all cases the balance being iron, and incidental elements e.g. such as noted, or in trace amounts): 0.07% C, 1.538% Mn, 0.574% Si, 0.037% Al, 0.117% Cb, 0.089% V, 0.018% N, with (rare earths for sulfide shape control) 0.018% Ce and 0.007% La, and low values of phosphorus, sulfur and oxygen, i.e. 0.008% P, 0.007% S and 0.001% oxygen. This heat was prepared in the manner described above, a particularly satisfactory rolling sequence used in this and other preferred heats described herein, being hot rolling to finish gage at a finish temperature of 1550° to 1650° F or a little higher, cooling rather rapidly (in the range of rates mentioned above), with water jets if necessary, to a temperature in the range of 1000° to 1225° F (or slightly above) for coiling or stacking.

Thus among other (and equally good) products of this heat, five hot rolled coils of gage about 0.09 inch were satisfactorily produced at finish temperatures varying from 1600° to 1700° F, with coiling temperatures varying (in random relation to finish values) from 1020° to 1160° F. These showed excellent properties, with very good uniformity, viz. upwards of 86 ksi yield strength (here and elsewhere herein determined at 0.2% offset) in various directions and various parts of the coil, and upwards of 100 ksi ultimate tensile strength similarly measured. Similar uniformity of results, among different heats and among different coils from each heat and different locations in each coil was observed in products from a number of like heats (mentioned below) with finish temperatures from 1550° to 1680° and coiling temperatures from 1160° to 1260°, i.e. yield strength upwards of 83 ksi and ultimate tensile of 94 ksi and above. Average elongations (2 inches) for the various coils ranged from about 21% to 26% or higher.

As mentioned, other examples of products having the desired composition were produced with comparably superior results. Considering the above product and four other heats as representative, the variation of individual element contents (balance iron) in weight percent was: carbon 0.058 to 0.094, manganese 1.347 to 1.538, silicon 0.495 to 0.574, aluminum 0.018 to 0.054, columbium 0.093 to 0.130, vanadium 0.078 to 0.089, nitrogen 0.016 to 0.024, cerium 0.015 to 0.027 and lanthanum 0.004 to 0.009. Phosphorus and sulfur maxima were 0.01%, oxygen 0.002%. The average of these compositions, wherein the variations were random relative to each other, was (in percent) 0.078 C, 1.48 Mn, 0.554 Si, 0.034 Al, 0.114 Cb, 0.084 V, 0.019 Ce, 0.007 La, 0.018 N, 0.008 P, 0.007 S and 0.001 oxygen.

From measurements of hot rolled products of the above heats, of selected thicknesses from 0.09 to 0.22 inch, the average yield strength was 87.1 ksi, longitudinal, and 91.1 ksi, transverse, with average ultimate tensile 103 ksi, longitudinal, and 105 ksi, transverse. The average percent elongations (2 inches) were 24.8 longitudinal and 23.6 transverse, being generally 20 or more and thus indicating good ductility. The toughness properties were excellent; Charpy V-notch tests, measured with half-size specimens (at temperatures determined in degrees F.), on products of the same heats, showed average impact values on specimens taken in the longitudinal direction (direction of rolling), measured in foot-pounds, of 43.8 at +70°, 40.2 at +20°, 37.1 at −20°, 34.2 at −60°, and 30.5 at −100°. On transverse specimens, the average impact values in foot-pounds were 30.2 at +70°, 28.4 at +20°, 26.8 at −20°, 23.8 at −60°, and 21.1 at −100°. Deviations from these values in individual cases were not large, indicating that the improved steels are capable of substantially exceeding values of 20 foot-pounds, longitudinal, and 10 foot-pounds, transverse, at −100° F, representing superior low temperature toughness.

As explained above, it appears that the addition of both vanadium and silicon in these steels affords an unusual result, indicative of a synergism that is not explicable by the known properties of these elements. Thus in one series of tests, Charpy V-notch determinations were first made on columbium-containing steels which had low carbon compositions (including manganese and columbium) that were generally similar to products of the above examples, but lacking vanadium and having no significant silicon content, i.e. from 0.012 to 0.025 Si. Then similar steels were produced with additions of vanadium, e.g. 0.03 to 0.055%. In all cases, the latter compositions showed a definite decrease in toughness (Charpy impact values), being marked at low temperatures e.g. −60° and −100° F. The increase in yield strength was relatively modest.

Although additions of silicon (of the extent employed in the new products are normally characterized by substantial decrease in toughness, with relatively moderate improvement in yield strength, the combination of vanadium and silicon contents in the present steels was found to afford a very significant and uniform increase in yield strength, with little or no decrease in toughness as compared with the basic steels containing only columbium as special alloying element. Indeed, tests showed that the Charpy impact values were relatively unaffected, or were even improved.

Specifically a steel containing only 0.02 Si, and high Cb (0.094), with no vanadium, revealed yield strengths of 76 ksi longitudinal and 79 ksi transverse and corresponding impact values of 40 and 22 foot-pounds at −40° F. A like composition with 0.05% vanadium added exhibited yield strengths of 80 and 85 ksi and impact values of 37 and 21 (−40° F), similarly measured. In marked contrast, the steel of the first example above, containing both vanadium and silicon (0.57%) as well as columbium, had markedly higher yield strengths of 87 and 92 ksi and impact values of 37 and 26 (at −40° F), whereas such addition of silicon alone would have been expected to have a lesser effect on yield strength and a detrimental effect on toughness. It should be noted that in all these tests the steels were otherwise comparable, for example as to low carbon content and as to a manganese content in the range of 1.25 to 1.6%.

With reference to the above examples and to good reliability of attainment of desired results (of strength, toughness, ductility) regardless of variables in processing, it presently appears that for products which have been, for example, hot-deformed to a reduction of at least 50%, particularly suitable compositions are characterized by the following contents of significant elements (balance iron and incidentals): 0 to 0.1% C (conveniently 0.03 to 0.1% C), 0.3 to 1.65% Mn, 0.2 (ordinarily preferably from 0.4) to 0.6% Si, 0.06 to 0.15% Cb, 0.03 to 0.2% V; the composition may also, indeed preferably, include a sulfide shape control agent, as in known, customary amount, thus definable as up to 0.2% of sulfide shape control agent. Such agent when desired is included in an effective amount in a range above 0.01%, for example up to 0.1% being usually sufficient for rare earth addition and up to 0.2% for zirconium. As will be understood, the steel is preferably aluminum-killed.

The product can be further defined as including from zero to the following maximum percentages of the following elements, 0.03 max. P, 0.03 max. S, 0.03 max. N, 0.09 max. Al. Mention of oxygen is omitted as in effect an incidental element, being usually not more than 0.003%, often only about 0.001%. Compositions within the ranges (as to all elements) given last above appear to exhibit fully the synergistic effects that have been noted, i.e. including along with high yield strength (well above 80 ksi), superior toughness (especially in subzero condition), high total elongation and thus improved formability.

A presently preferred range of compositions, for economy and assurance of results, comprises 0. to 0.1% C (again, conveniently upwards of 0.03%), 0.8 to 1.65% Mn, 0.4 to 0.6% Si, 0.07 to 0.14% Cb, 0.05 to 0.15% V, and other elements as noted in connection with the above somewhat wider ranges, but preferably including up to 0.025% (e.g. at least about 0.005) nitrogen, 0.01 to 0.06 Al, and an effective amount of sulfide shape control agent, e.g. up to 0.2%. The nature of such agents has been explained above; an especially useful agent consists of one or more elements of the class consisting of the rare earths and, with low nitrogen levels, zirconium.

As will now be appreciated from all of the foregoing, a number of variations and selections, as to individual alloying elements, i.e. each considered by itself, are illustrative of general aspects of the composition. Thus for some purposes, columbium can be as low as 0.04% (or possibly down to 0.03%), preferably at least 0.05%, but with special advantage for more than 0.08%, preferably a range of 0.09% and above, e.g. to 0.14%. Likewise manganese can be varied independently of other elements, i.e. within ranges elsewhere given herein, a very useful range being 0.8 to 1.6%. While it is conceivable that in some cases a low silicon content can be employed, e.g. down to 0.2%, especially (though perhaps not necessarily) in situations of the preferred contents of carbon, columbium and vanadium, it is contemplated that superior results require a significant content of silicon, e.g. 0.4% or more, usually not above 0.6% although it is conceivable that silicon could sometimes be as much as 0.8%. Vanadium, another important element considered independently of the others, may broadly lie in the range of 0.03% (preferably at least 0.04%) and above, and even up to 0.2%; a greater preferred range is 0.05% to 0.1%.

A specific example of a steel, according to the invention, that is capable of higher strength in as-hot-rolled condition, e.g. quite substantially higher than 80 ksi, is the following approximate composition as to elements of principal significance; 0.07% C max., 1.50% Mn, 0.60% Si, 0.15% V, 0.10% Cb, 0.017% nitrogen.

As will now be seen, the invention affords new high strength, low alloy steels that attain excellent tensile properties, toughness, ductility and formability, that are economical to make and use, and that can be produced with good reliability as to attainment of desired results.

It is to be understood that the invention is not limited to the specific embodiments herein described but may be carried out in other ways without departure from its spirit.

We claim:

1. A high strength steel product produced by hot rolling, and having yield strength of at least 80 ksi longitudinally and transversely, said steel consisting essentially of 0.05 to 0.10% C, 0.5 to 1.65% Mn, 0.2 to 0.8% Si, 0.08 to 0.15% Cb, 0.05 to 0.15% V, 0 to 0.2% of sulfide shape control agent, and from 0 to the following maximum percentages of the following elements, 0.03 max. P, 0.03 max. S, 0.03 max. N, 0.09 max. Al, balance iron and incidental elements.

2. A steel product as defined in claim 1, which contains 0.8 to 1.65% Mn.

3. A steel product as defined in claim 1, which contains 0.08 to 0.12% Cb.

4. A steel product as defined in claim 1, which is produced by hot rolling to a finish temperature in the range of about 1500° F to 1850° F, cooling to a temperature in the range of about 900° F to 1300° F and collecting, at said temperature to which the hot-rolled steel is cooled, by coiling or piling, said steel being aluminum killed.

5. A steel product as defined in claim 4, which contains 0.8 to 1.65% Mn, 0.08 to 0.12% Cb, and 0.05 to 0.15% V.

6. A steel product as defined in claim 1, which is produced by hot rolling to a reduction of at least 50%.

7. A high strength steel product having yield strength of at least 80 ksi longitudinally and transversely and produced by hot deformation to a reduction of at least 50%, said steel consisting essentially of 0.03 to 0.10% C, 0.3 to 1.65% Mn, 0.2 to 0.8% Si, 0.08 to 0.15% Cb, 0.05 to 0.20% V, 0 to 0.2% of sulfide shape control agent, and from 0 to the following maximum percentages of the following elements, 0.03 max. P, 0.03 max. S, 0.03 max. N, 0.09 max. Al, balance iron and incidental elements.

8. A steel product as defined in claim 7, which contains 0.8 to 1.65% Mn, 0.08 to 0.12% Cb, and 0.05 to 0.15% V.

9. A steel product as defined in claim 7, which is aluminum killed and is produced by hot rolling to said reduction, and which contains 0.05 to 0.10% C.

10. A steel product as defined in claim 7, which contains and 0.5 to 1.65% Mn.

11. A steel product as defined in claim 10, which contains 1.25 to 1.60% Mn.

* * * * *